United States Patent [19]

O'Connor

[11] Patent Number: 5,027,867

[45] Date of Patent: Jul. 2, 1991

[54] TOOL AND METHOD FOR TENSIONING WIRE

[76] Inventor: Michael P. O'Connor, 9040 Sterling Creek Rd., Jacksonville, Oreg. 97530

[21] Appl. No.: 519,819

[22] Filed: May 7, 1990

[51] Int. Cl.[5] ..... B21F 9/00

[52] U.S. Cl. ..... 140/123.5; 140/104

[58] Field of Search ..... 140/104, 123.5, 123.6; 254/251, 252, 257; 24/129 R, 129 A

[56] References Cited

U.S. PATENT DOCUMENTS

| | | | |
|---|---|---|---|
| 742,903 | 11/1903 | Reed | 254/252 |
| 867,241 | 10/1907 | Burton | 254/252 |
| 1,374,681 | 4/1921 | Ray | 140/123.6 |
| 1,430,388 | 9/1922 | Leslie | 140/123.5 |
| 2,264,794 | 12/1941 | Gunderson | 254/252 |
| 2,451,389 | 10/1948 | Howe | 140/123.5 |
| 2,511,305 | 6/1950 | Tell | 254/76 |
| 3,003,657 | 10/1961 | Siebol et al. | 218/42 |
| 3,048,296 | 8/1962 | Heidenwolf | 218/42 |
| 3,154,210 | 10/1964 | Elliott et al. | 218/42 |
| 3,824,653 | 7/1974 | Sholler | 24/134 |
| 4,306,592 | 12/1981 | Drage | 140/123.5 |
| 4,483,517 | 11/1984 | Cavalieri | 254/254 |
| 4,615,509 | 10/1986 | Biass | 254/264 |

*Primary Examiner*—Lowell A. Larson

*Attorney, Agent, or Firm*—James D. Givnan, Jr.

[57] ABSTRACT

A tool having a pivoted handle which intermittently retracts a sleeve to close jaws within the sleeve into wire engagement for wire retraction. The wire so tensioned is incrementally advanced axially into a wire retainer assembly and past retainer jaws which admit the wire and hold same against high tension loads. A manual control permits disengagement of the tool retainer jaws from the wire, after wire securement to a support, to enable axial disengagement of the tool from a length of tensioned wire. Methods are disclosed for tensioning and joining two lengths of wire using the present tool. Wire coiling tools are disclosed facilitating the practice of the methods.

11 Claims, 2 Drawing Sheets

37
38
36A
39B
W1
36
39
40

37
38
37
W1
38
41
W1
W1
42
W1

37
W1
38
42
43
W2
44
43
W2
45
41

37
38
42
44
W2
43
9
9
42
44
41
W1
W2
43

49
W2'
48
47
W2'
49
47
46

W1'
W1'
50
W2'
39
39B
W1
36A
40
W1

36

TOOL AND METHOD FOR TENSIONING WIRE

BACKGROUND OF THE INVENTION

The present invention pertains generally to a tool for tensioning wire, as for example, wire used in a high tensile trellis in a fruit tree orchard or a vineyard.

To increase per acre production, it is now an accepted practice to train the branches of fruit trees along horizontal wire trellises consisting of vertically spaced runs of wire. The original installation of trellis wire and periodic re-tensioning of same with known tools is a time and labor intensive effort. Further, existing equipment and fittings used for tensioning and locking wire under high tensile loads are costly to the owner of a large commercial orchard. With existing practices and equipment, it is not uncommon to periodically tension the wires of a trellis by means of a costly ratchet mechanism which remains in place on each wire of the trellis. Such devices are termed in the trade in-line wire strainers and wind the wire about a radius preventing reuse of the wire.

SUMMARY OF THE PRESENT INVENTION

The present invention concerns a tool and method for tensioning wires and articles of wire construction.

The tool disclosed utilizes a wire retractor assembly and a cooperating wire retention assembly which receives the wire from the retractor assembly in an incremental, unidirectional manner.

The present tool has an elongate housing in which a retractor assembly reciprocates. The wire receiving end of the tool is adapted for abutment with a fixed support for transferring wire tensioning loads to the support. Wire gripping jaws close into wire engagement during forceful closing of a tool handle. Release of the tool handle permits the spring biased jaws to advance along the wire whereat jaw closure is effected by a sleeve actuated by a tool handle. Carried by a remaining handle of the tool is a wire retainer assembly which also includes spring biased jaws which prevent wire movement in an opposite direction. A manually adjusted control permits disengagement of the retainer jaws from the wire for tool and wire separation.

Methods are disclosed for joining lengths of wire in a highly tensioned manner for use in the construction of wire trellises, for example. A wire coiling tool is disclosed to facilitate practicing one or both of the above noted methods or the forming of a clamp for circular articles.

Important objectives of the present tool and methods include the provision of a tool and system for tensioning a wire to several hundreds of pounds as used in trellises supporting the limbs of fruit trees; the provision of a tool and system for tensioning wire clamps, as for example, circular wire clamps used on pipes and hoses; the provision of a tensioning tool which may be periodically attached to the end of a trellis wire for tensioning same; the provision of methods for tensioning lengths of wire at low cost and allowing periodic tightening.

DETAILED DESCRIPTION OF THE PREFERRED EMBODIMENTS

Figure 1:
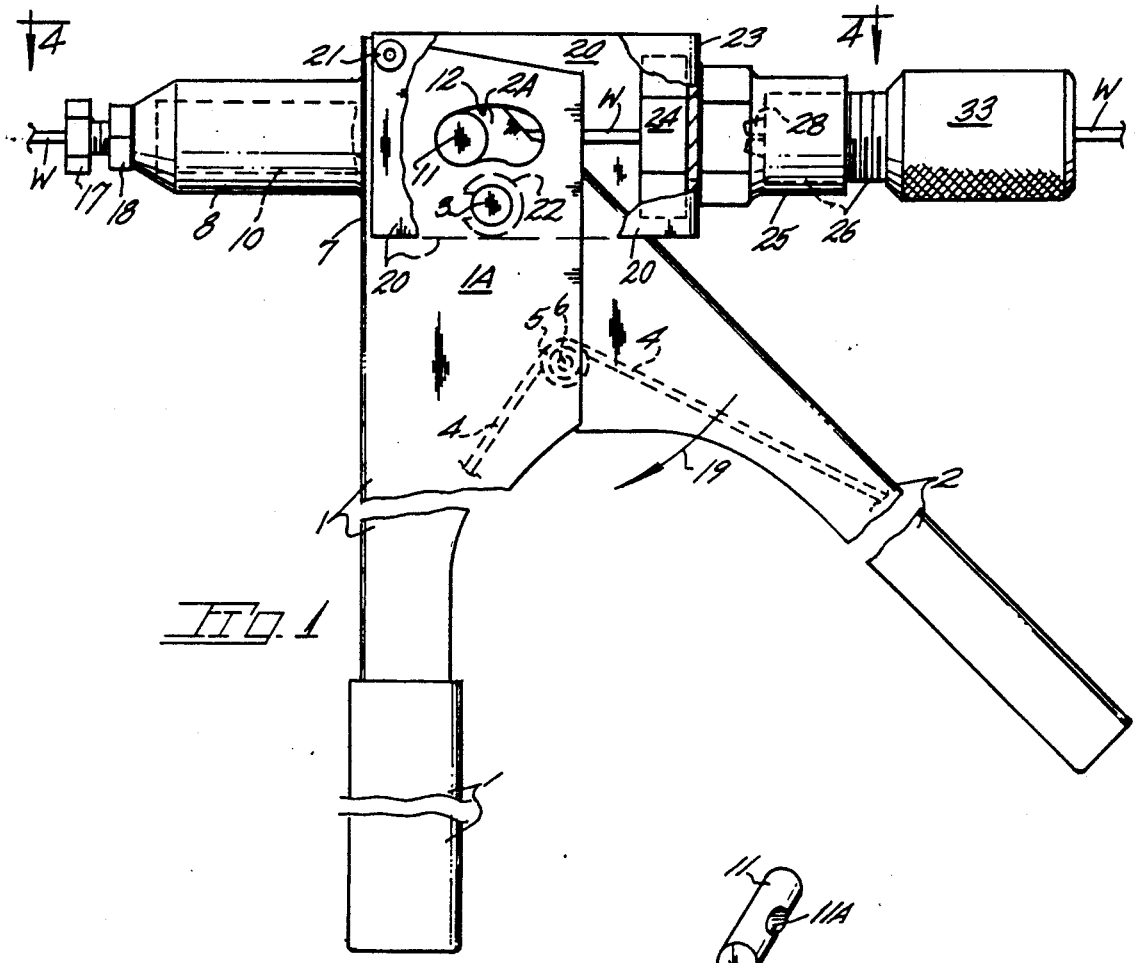
FIG. 1 is an elevational fragmentary view of the present tool.

With continuing attention to the drawings wherein applied reference numerals indicate parts similarly hereinafter identified, and particularly to FIG. 1 thereof, the reference numeral 1 indicates a primary handle of the tool with a secondary handle indicated at 2 pivotally attached to handle 1 by a pivot pin 3. A spring 4 has a coiled portion 5 carried by a pin 6 in place on handle 2. Spring arms bias the handles apart in the absence of a manually exerted closing force. A base 1A is integral with handle 1. On a front wall 7 of the base is affixed a tubular nose 8.

Figure 2:
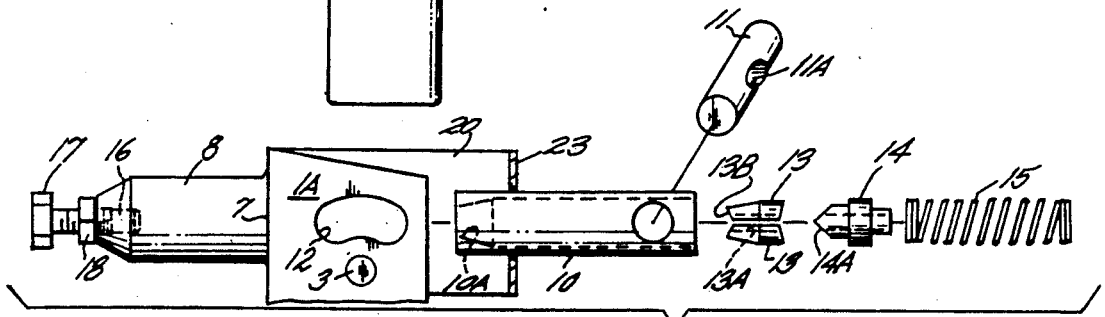
FIG. 2 is an exploded view of the retractor assembly of the tool.

A wire retractor assembly of the tool includes a sleeve 10 for reciprocal movement within tubular nose 8. The rearward end of sleeve 10 is transversely apertured to receive a pivot pin 11, the ends of which are journalled in the upper end portion 2A of handle 2. Arcuate slots, as at 12 in handle 1, limit fore-and-aft rocking of pin 11 to reciprocate sleeve 10. With particular attention to FIG. 2, the wire retractor assembly additionally includes a pair of wire engaging retractor jaws 13 which are closed into engagement with a wire W in sleeve 10 by the action of a conical end segment 10A of sleeve 10. To enable passage of wire W through sleeve 10, pivot pin 11 is apertured at 11A. Accordingly, jaw engagement with the wire is effected by closing movement of handle 2 drawing sleeve 10 to the right as viewed in FIG. 1. In the absence of sleeve 10 being urged to the right during wire retraction, the jaws are normally spread apart from the wire by a jaw separator 14 having a wedge shaped forward end 14A. Separator 14 is biased to a jaw separating direction (to the left in FIG. 1) by a spiral spring 15 held within sleeve 10 by pin 11. During retraction of sleeve 10 by closing movement of handle 2 in the direction of arrow 19, the conical internal surface 10A of the sleeve closes the retractor jaws 13 into firm engagement with the wire. To contribute to positive jaw engagement with wire W, the opposed grooved surfaces 13A of the jaws may be serrated or embossed. The wire receiving ends 13B of jaws 13 are beveled to facilitate jaw opening by a limit stop later described. A jaw limit stop is indicated at 16 and includes a bolt 17 in threaded engagement with the end of tubular nose 8 with the bolt end imparting a slight spreading action to the retractor jaws 13 to retain the jaws somewhat open when full forward in a static condition to permit manual insertion of a wire end segment at the start of a wire tensioning operation and tool removal at the end of the operation. A lock nut is at 18.

Figure 3:
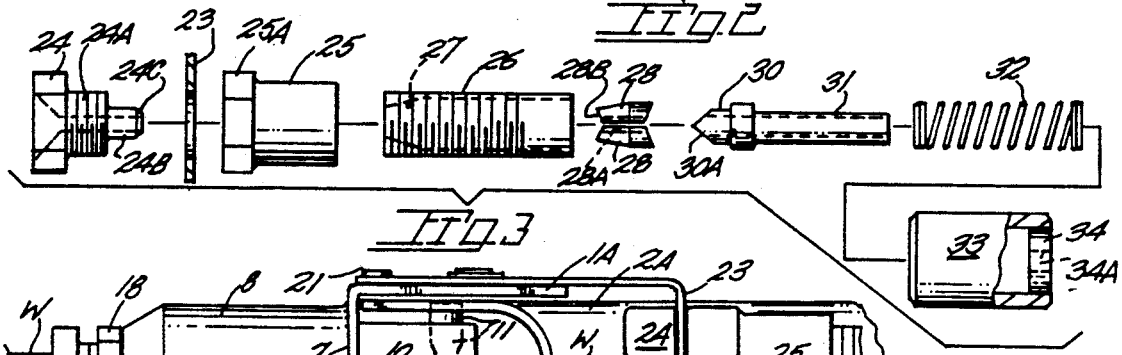
FIG. 3 is an exploded view of the retainer assembly of said tool.
Figure 4:
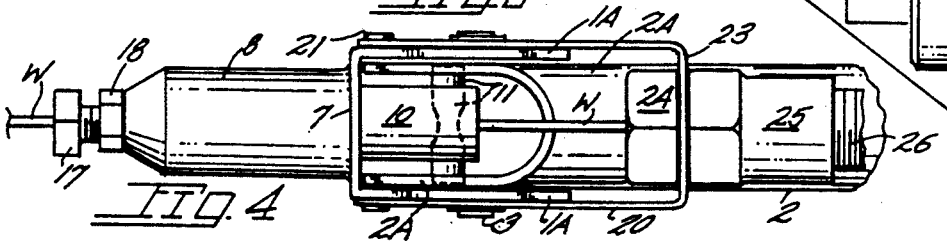
FIG. 4 is a fragmentary plan view of FIG. 1 taken along line 4—4 of FIG. 1.

A wire retainer assembly, as shown in FIG. 3, is carried by a U-shaped bracket 20 in place on base 1A by means of rivets at 21 and snap rings 22 on grooved pivot pin 3. The wire retainer assembly serves to permit incremental, unidirectional passage of wire W during tensioning while automatically locking the wire against opposite movement.

U-shaped bracket 20 has a rearward web 23 which is apertured to receive a wire guide 24 having a hexagonal head portion confined within the bracket. Guide 24 has a threaded segment 24A for threaded engagement with an internally threaded sleeve 25 also provided with a tool receiving head 25A to permit clamping of the wire retainer assembly to bracket web 23. Wire guide 24 additionally includes a tubular projection or stud 24B having a chamfered end 24C. Internally threaded sleeve 25 adjustably receives an externally threaded sleeve 26 having an internal conical surface 27 at the sleeve forward end. A pair of retainer jaws 28 seat within conical portion 27 of the sleeve with said conical portion serving as a cam to urge the jaws closed against a segment of wire therebetween. A retainer jaw separator 30 has a wedge shaped forward end 30A for separating of the jaws while a tubular spindle 31 serves to carry a spiral spring 32 with the spindle isolating the wire from the spring. The wire receiving ends 28B of jaws 28 are beveled to facilitate jaw opening by stud end 24C. A finger grip control member 33 is tubular for installation on sleeve 26 in a pressed fit manner. An end closure 34 retains spring 32 and is apertured at 34A to permit passage of the wire being tightened. Manual rotation of finger grip control 33 causes sleeve 26 to advance or retract relative internally threaded sleeve 25 with advancement of sleeve 26 into sleeve 25 resulting in spring 32 further biasing jaw separator 30 to hold jaws 28 apart, now against chamfered end 24C of guide 24, to allow jaw travel along the wire during tool removal. Conversely, rotation of finger grip control 33 in an opposite or backing off direction reduces the influence of spiral spring 32 on separator 30 and on jaws 28 to permit jaw closure against a wire by conical surface 27 of sleeve 26. As in the first described pair of jaws, the jaws 28 may have opposed, serrated surfaces 28A to enhance jaw engagement with the wire.

Figures 5, 6, 7, 8, 9, 10, 11:
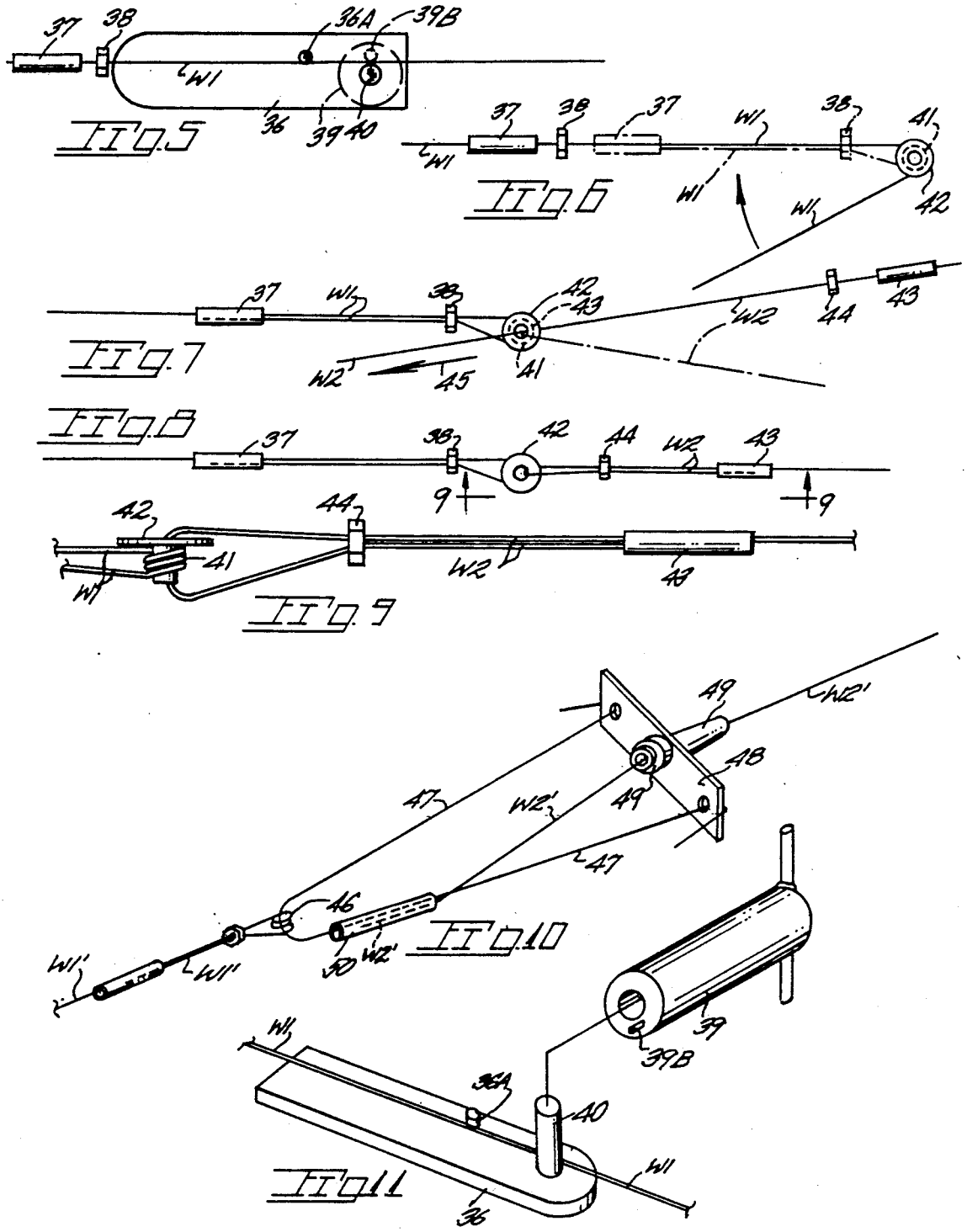
FIG. 5 is a schematic view of a length of wire in place on a wire coiling tool.
FIGS. 6, 7 and 8 are schematic views of one method of tightening and securing two lengths of wire.
FIG. 9 is an enlarged elevational view taken along line 9—9 of FIG. 8.
FIG. 10 is a schematic view of a second form of tightening and securing two lengths of wire to one another.
FIG. 11 is an exploded view of a coil forming tool for use with the present invention.

With attention to FIGS. 5 through 9 wherein a preferred method is illustrated for joining wires in an aligned, tensioned manner, a first wire W1 is shown in place on a wire holding tool 36 the use of which is later described in detail. Prior to placement of wire W1 on the tool, a tubular guard 37 and a nut element 38 are slid into place spaced from the wire end. As shown in FIG. 5, wire W1 is wrapped by a cooperating bending tool 39, later described, about a post 40 on tool 36 to form a coil or eye 41 of two or so turns. A flat head tubular rivet 42 in FIG. 9 constitutes a tubular insert or fitting and is subsequently inserted into the coil 41 and frictionally secured in place therein by manual closing of the wire end segment per the arrow to the broken line position of FIG. 6 i.e., parallel to the main portion of wire W1. Nut element 38 is then advanced along doubled wire W1 toward rivet 42 further contracting the coil about rivet 42 to grip same. Guard 37 is subsequently advanced along wire W1 to conceal the end of wire W1 to prevent injury.

In FIG. 7, a second wire W2 is shown inserted through tubular rivet 42 after placement of a guard 43 and a nut element 44 on wire W2. The end segment of wire W2 is now inserted through the present tool with tubular nose 8 of the tool positioned in place obliquely against rivet 42. Tool operation results in retractor sleeve 10 of the wire retractor assembly moving in a reciprocating manner to advance the wire through the assembly and through the wire retention assembly in the direction of arrow 45. The latter assembly and, specifically adjustment control 33 and sleeve 26 thereof, will be backed off to reduce the action of spring 32 on jaw separator 30. Accordingly, jaws 28 will permit unobstructed passage of wire W2 from the retractor assembly while reverse movement of the wire is prevented by retainer jaws 28 being closed into wire contact by conical surface 27 of sleeve 26. Upon wire W2 being tensioned to the desired state, the tool is angularly displaced or swung about rivet 42 with the rivet acting as a fulcrum during tool displacement to locate wire W2 to the broken line position of FIG. 7. In orchard or vineyard trellis construction, it is common to use 12½ gauge galvanized hi-tensile wire which, when bent as shown in FIG. 7, will remain in hooked engagement with the rivet. For tool removal from the wire, finger grip control 33 with sleeve 26 are advanced to cause jaw separator 30 to separate retainer jaws 28 while simultaneously urging the jaws forwardly into jaw opening contact with the chamfered or tapered end 24C of wire guide stud 24B. Subsequent to removal of the tool from wire W2, the end segment of wire is swung further into parallel relationship with the main portion of wire W2 whereat nut element 44 is advanced to the position shown in FIGS. 8 and 9 with the attachment being completed by the advancement of guard 43 to conceal the end of wire W2 for injury avoidance. The nut elements 38 and 44 are practical for the reason that internal threads of the nut elements resist displacement along the wire and are of low cost. Obviously other fittings could be used.

A second method for attaching wires to one another in an aligned tensioned manner is disclosed in FIG. 10 wherein a wire W1' may be coiled at 46 and doubled back in the manner above described. A bridle 47 extends through coil 46 with the bridle ends in hooked engagement through a cross member 48 which is centrally apertured to receive a strain relief or wire lock 49. Such wire locks are in wide use with one suitable lock being manufactured by Reliable Power Products, Inc., and sold under the registered trademark WIREVISE. Such wire locks permit insertion of a wire therethrough in one direction and automatically lock the wire in place against movement in an opposite direction. A second wire W2' is threaded through the wire lock and thence through the present tool to permit the end of tool nose 8 to be in abutment with the proximal end of wire lock 49. Subsequent tool operation permits tensioning of wires W1' and W2' with the tensioned state of the wires maintained by wire lock 49 after tool removal. The end segment of wire W2' is now trimmed to a convenient length for insertion within a tubular guard 50 in place on bridle 47.

In both of the foregoing methods, it will be seen that the present tool may be periodically applied to the end segments of wires W2 and W2' (after some straightening of the W2 segment), the tool aligned with the remainder of the wire and a tightening operation conducted. The use of a tubular rivet at 42 is preferred as the rivet will deform to provide an adequate radius to preserve the galvanized condition of the wire passing therethrough. In some instances the rivet could be dispensed with.

In FIG. 11 the earlier mentioned wire coiling tool 36 and companion tool 39 are disclosed. Tool 36 includes a barrier 36A to confine the wire during a coiling operation. Companion tool 39 has a central bore 39A for reception of post 40. A pin 39B on the lowermost end of tool 39 is rotatable into wire engagement with a full circuit of travel about post 40 resulting in the formation of one wire coil or eye. Companion tool 39 is repositioned simultaneously on post 40 to permit additional travel of pin 39B about the post without contacting the span of wire between barrier 36A and post 40. It has been found satisfactory to form the coil with approximately one and one third rotations of companion tool 39 whereafter the tubular insert or rivet is placed within the coil and the wire end segment thereafter closed into parallel relationship with the major portion of the wire.

The present tool may be utilized for the constriction of hoses and other tubular articles including pipes of synthetic material to provide a clamp formed by two or three wraps of wire about the end of the article. The wire is tensioned by passing same through an eye at one end of the wire. The tool nose 8 is placed for support by the eye whereafter tool operation draws the wire through the eye to close the wire wraps about the tubular article. As several hundred pounds of tension may be applied with the present tool, it is possible to contract the end segment of plastic tubing about an interiorly disposed fitting or nipple. Subsequent to tensioning of the wire the tool is angularly displaced beyond ninety degrees for hooked engagement with the eye whereafter finger tip control 33 is advanced toward internally threaded sleeve 25 to disengage retainer jaws 28 from the wire to permit axial tool separation from the wire.

While I have shown but one embodiment of the invention, it will be apparent to those skilled in the art that the invention may be embodied still otherwise without departing from the spirit and scope of the invention.

Having thus described the invention, what is desired to be secured by a Letters Patent is as follows.

I claim:

1. A tool for tensioning wire and adapted for abutment with a support during tensioning of a wire, said tool comprising, a wire retractor assembly for incremental axial advancement of a wire, a tool handle assembly including a base/handle coupled to said retractor assembly for actuating same, and a wire retainer assembly on said base for receiving wire advanced by said wire retractor assembly and including retainer jaws, a retainer sleeve with a conical segment cooperating with the jaws to lock the wire against movement in the opposite direction, a jaw separator, manually adjustable control means operable to move said jaw separator into retainer jaw engagement for jaw release from the wire whereby the tool may be removed from a length of wire.

2. The tool claimed in claim 1 wherein said wire retractor assembly includes retractor jaws, a limit stop engaged by said retractor jaws for releasing the retractor jaws from the wire when the retractor assembly is static.

3. The tool claimed in claim 2 wherein said wire retractor assembly includes a retractor sleeve having a conical segment acting on said retractor jaws, a pivot pin apertured for wire passage coupling said retractor sleeve to said handle.

4. The tool claimed in claim 1 wherein said wire retainer assembly additionally includes a wire guide, a projection on said wire guide engaged by said retainer jaws during adjustment of said manually adjustable means to impart opening movement to the jaws in concert with said jaw separator.

5. The tool claimed in claim 1 wherein said manually adjustable means includes a finger grip on said retainer sleeve, a spring interposed between said finger grip and said jaw separator, manual rotation of said finger grip and said sleeve serving to alter the biasing action of said spring on said jaw separator.

6. A tool for tensioning wire, said tool comprising, a first handle member including a base for contact with a support, a second handle member pivotally carried by said first handle member, a wire retractor assembly carried by said base for imparting incremental axial movement to a length of wire, said wire retractor assembly including retractor jaws and a limit stop engaged by said retractor jaws for releasing the retractor jaws from the wire when the retractor assembly is static, pivot means coupling said second handle member to said wire retractor assembly for actuating same, and a wire retainer assembly on said base and including retainer jaws admitting said length of wire in incremental fashion and normally locking same against movement in an opposite direction, manually adjustable control means positionable to alternatively permit engagement of said retainer jaws with the wire and subsequent disengagement of said retainer jaws from the wire to permit axial removal of the tool from the wire.

7. The tool claimed in claim 6 wherein said wire retractor assembly includes a retractor sleeve having a conical segment acting on said retractor jaws, a pivot pin apertured for wire passage coupling said retractor sleeve to said handle.

8. The tool claimed in claim 6 wherein said wire retainer assembly additionally includes a wire guide, a projection on said wire guide engageable with said retainer jaws during adjustment of said manually adjustable control means to impart opening movement to the retainer jaws.

9. A method for joining and tensioning first and second lengths of wire, said method comprising the steps of, sliding tubular guards and nut elements on the first and second lengths of wire, forming an eye in the first length of wire, inserting the second length of wire through said eye and into a wire tensioning tool, abutting an end of the wire tensioning tool against said eye, said wire tensioning tool having a wire retractor assembly and a wire retainer assembly, actuating the tool to tension the lengths of wire, bending an end segment of the second length of wire about the eye, withdrawal of the tool along the second length of wire, advancing the nut elements and the guards over end segments of each of the lengths of wire.

10. The method in claim 9 including the additional steps of coiling the wire to form said eye, inserting a tubular member in said eye prior to inserting the second length of wire through said eye.

11. A method for joining and tensioning lengths of wire, said method comprising the steps of, attaching a bridle to the end of a first length of wire, coupling the ends of the bridle to a cross member having a wire lock thereon, inserting an end segment of a second length of wire through said wire lock, placing a wire tensioning tool in endwise abutment with said wire lock, said wire tensioning tool having a wire retractor assembly and a wire retainer assembly, actuating the tool to tension the second length of wire, displacing the tool along the second length of wire for tool disengagement from same.

* * * * *